US005647972A

United States Patent [19]

Kantorowicz et al.

[11] Patent Number: 5,647,972

[45] Date of Patent: Jul. 15, 1997

[54] LOW PRESSURE CHILLING TRAIN FOR OLEFIN PLANTS

[75] Inventors: Steven I. Kantorowicz, Nutley; Stephen J. Stanley, Matawan, both of N.J.; David M. Wadsworth, Laconia, N.H.; Rene C. L. Warner, Benthuizen, Netherlands

[73] Assignee: ABB Lummus Global Inc., Bloomfield, N.J.

[21] Appl. No.: 369,177

[22] Filed: Jan. 5, 1995

[51] Int. Cl.[6] ..... C07C 7/00

[52] U.S. Cl. ..... 208/100; 208/102; 208/103; 208/104; 208/105; 585/802

[58] Field of Search ..... 208/100, 102, 208/103, 104, 105; 585/802, 648, 655; 423/650

[56] References Cited

U.S. PATENT DOCUMENTS 5,453,177 9/1995 Goebel et al. ..... 208/102

5,502,266 3/1996 Hodson ..... 585/802

*Primary Examiner*—Glenn A. Caldarola
*Assistant Examiner*—Walter D. Griffin
*Attorney, Agent, or Firm*—Chilton, Alix & Van Kirk

[57] ABSTRACT

A method of processing a cracked gas feedstream containing hydrogen and $C_1$ to $C_6$ and heavier hydrocarbons is described using a relatively low pressure as compared to conventional cryogenic separation processes. At pressures below 27 bars, the feedstream is dried and cooled in a series of steps to initially separate out essentially all of the $C_6$ and heavier hydrocarbons forming a vapor stream containing the hydrogen, the $C_1$ to $C_3$ hydrocarbons and at least some of the $C_4$ and $C_5$ hydrocarbons. The $C_4$ and $C_5$ components act as an absorption liquid to lower the light ends partial pressure permitting the condensation of $C_2$ and $C_3$ components at higher temperature levels and permitting the operation at lower pressures. The vapor stream is then further cooled and separated in another series of steps and processed in a demethanizer column in a manner to provide a high pressure hydrogen and methane overhead product and a high recovery of $C_2$ and $C_3$ components in the bottoms.

8 Claims, 1 Drawing Sheet

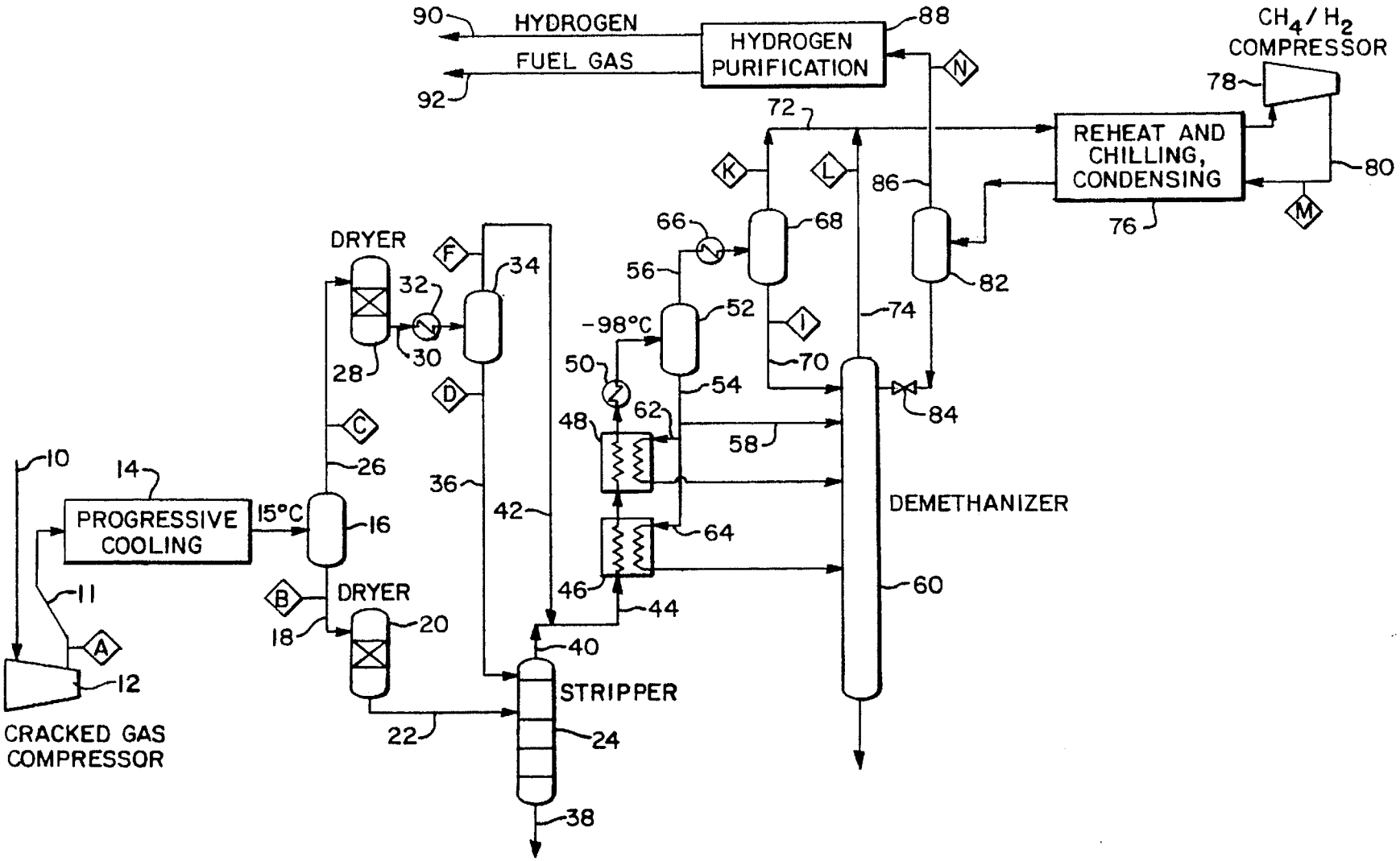
CH4/H2 COMPRESSOR
REHEAT AND CHILLING, CONDENSING
DEMETHANIZER
HYDROGEN PURIFICATION
HYDROGEN
FUEL GAS
STRIPPER
DRYER
DRYER
PROGRESSIVE COOLING
CRACKED GAS COMPRESSOR
-98°C
15°C
10
11
12
14
16
18
20
22
24
26
28
30
32
34
36
38
40
42
44
46
48
50
52
54
56
58
60
62
64
66
68
70
72
74
76
78
80
82
84
86
88
90
92
A
B
C
D
F
I
J
K
L
M
N

LOW PRESSURE CHILLING TRAIN FOR OLEFIN PLANTS

BACKGROUND OF THE INVENTION

The present invention relates to systems for the production of olefins by pyrolysis of hydrocarbon feedstocks and more particularly a low pressure chilling process and systems for separating hydrogen and methane.

The production of olefins involves the thermal cracking of a variety of hydrocarbon feedstocks ranging from ethane to heavy vacuum gas oils. In the thermal cracking of these feedstocks, a wide variety of products are produced ranging from hydrogen and methane to pyrolysis fuel oil. The effluent from the cracking step, commonly called charge gas or cracked gas, is made up of this full range of materials which must then be separated by fractionation into various product and by-product streams followed by hydrogenation of at least some of the unsaturated by-products.

In the majority of operating units, the cracked gas is compressed from approximately 1 to 1.4 bars up to 27 to 42 bars. The purpose of this compression is to permit the separation of hydrogen and methane from the $C_2$ and heavier components contained in the cracked gas. Generally, the cryogenic portion of the plant consists of chilling the relatively high pressure compressed gas by mechanical refrigeration and other cold process streams thereby condensing all the $C_2$ and heavier components. In addition, the compression permits the delivery of high purity hydrogen to the downstream hydrogenation processes at high pressures. This compression and cryogenic separation of the materials in the cracked gas is a very energy intensive and high capital investment process.

SUMMARY OF THE INVENTION

The object of the present invention is to provide a system and process for separating hydrogen and methane from a cracked gas feedstream at a relatively low pressure. A more specific object of the present invention is to cryogenically separate hydrogen and methane from a cracked gas feedstream in an olefin process at a pressure below 27 bars while maintaining high olefin recovery and producing high purity hydrogen at a relatively high pressure.

BRIEF DESCRIPTION OF THE DRAWINGS

FIG. 1 is a flow diagram of a portion of an olefin plant according to the present invention.

DESCRIPTION OF THE PREFERRED EMBODIMENTS

Referring to FIG. 1, there is illustrated a portion of an ethylene (olefin) plant beginning with the feedstream 10 of cracked gas from a pyrolysis reactor (not shown). The cracked gas 10 is fed to the cracked gas compressor 12 where the pressure is increased from the conventional cracking pressure, perhaps 1 to 1.4 bars, up to a pressure of less than 27 bars and preferably 10 to 17 bars. This pressure compares to the much higher pressure used in a conventional olefin plant of greater than 27 bars. The following Table 1 shows the temperatures, pressures and compositions of the various streams throughout the process to be described for one typical feedstream. Whenever preferred temperatures are mentioned in this description of the invention, such temperatures are by way of example and are for the specific preferred pressures that are recited. The preferred temperatures will vary with variations in the specific pressure employed and with variations in the feed composition.

TABLE 1

| Stream | Temperature Deg C. | Pressure bars | Hydrogen | Methane | C2's | C3's | C4+ |
|---|---|---|---|---|---|---|---|
| | | | mole fraction | | | | |
| 11 | 100 | 13.73 | 0.15 | 0.25 | 0.38 | 0.11 | 0.11 |
| 18 | 15 | 12.94 | 0.001 | 0.02 | 0.11 | 0.12 | 0.75 |
| 26 | 15 | 12.94 | 0.16 | 0.27 | 0.40 | 0.11 | 0.06 |
| 36 | 0 | 12.75 | 0.001 | 0.02 | 0.15 | 0.21 | 0.62 |
| 40 | 14 | 11.77 | 0.02 | 0.29 | 0.50 | 0.13 | 0.06 |
| 42 | 0 | 12.75 | 0.17 | 0.27 | 0.41 | 0.11 | 0.04 |
| 54 | −98 | 10.59 | 0.003 | 0.15 | 0.61 | 0.17 | 0.07 |
| 56 | −98 | 10.59 | 0.42 | 0.48 | 0.10 | 0.001 | — |
| 70 | −134 | 10.36 | 0.005 | 0.62 | 0.37 | 0.005 | — |
| 72 | −134 | 10.36 | 0.56 | 0.43 | 0.007 | — | — |
| 74 | −134 | 6.21 | 0.01 | 0.99 | 0.004 | — | — |
| 80 | 100 | 38.25 | 0.11 | 0.89 | 0.002 | — | — |
| 86 | −116 | 37.66 | 0.51 | 0.49 | 0.0001 | — | — |

The discharge 11 from the cracked gas compressor 12 at about 100° C. is progressively cooled at 14 by a series of mechanical refrigeration units or by heat exchange with cold process streams down to a temperature range of 10° C. to 25° C. and preferably about 15° C. The reason for only cooling to about 15° C. at this point is that the feed contains water which will form hydrates and "freeze" at temperatures lower than about 10° C. This feed must be dried before the downstream processing at lower temperatures. Therefore, the temperature at this point is lowered as much as possible in order to reduce the size of the driers without going down to a hydrate formation temperature. The cooled cracked gas feedstream is fed to the separator 16 where condensed liquid is separated from vapor. This is basically a rough separation of $C_4$ and lighter components as vapor and $C_5$ and heavier components as condensed liquid with most (94 mole %) of the feed remaining vapor. The small condensed liquid stream 18 is fed to a drier 20 where water is removed. This drier is preferably, but not necessarily, a liquid phase molecular sieve drier. Any viable method of drying hydrocarbon liquids to the established levels of dryness required for cryogenic processing can be employed for this service. These include, but are not necessarily limited to, solid desiccants such as alumina, or liquid drying agents such as glycol. The liquid phase drier effluent 22 containing 75% $C_4$ and heavier components is fed to the heavy ends stripper tower 24. The vapor stream 26 from the separator 16 is sent to the drier 28 which is preferably a vapor phase molecular sieve drier. The dried effluent 30 containing 94% $C_3$ and lighter components is further cooled at 32 down to a range of −20° C. to 5° C. and preferably to about 0° C. This further cooled stream is fed to the stripper tower feed drum or separator 34 where another rough separation is made between the $C_3$ and lighter components as vapor 42 and the $C_4$ and heavier components as liquid. About 5% of the flow to separator 34 leaves as liquid 36. The condensed liquid stream 36 at 0° C. from the separator 34 containing 62% $C_4$ and heavier components along with some $C_2$ and $C_3$ components is fed to the heavy ends stripper tower 24 above the feed 22. The heavy ends stripper 24 basically separates as bottoms 38 the $C_6$ and heavier components from the lighter components in the overhead 40. This stripper tower 24 makes a very controlled separation such that there are little or no $C_6$ and heavier components in the overhead that would cause freezing downstream. Table 2 shows the percentage of each component contained in the stripper bottoms 38 as a percentage of that component contained in the total feed 10.

TABLE 2

| Component | % of Total Component Feed Contained in Stripper Bottoms (Stream 38) |
|---|---|
| C2's | 1.7 |
| C3's | 9.5 |
| C4's | 32 |
| C5's | 64 |
| C6+ | 96 |

The combined vapor stream 44 from the stripper tower 24 and the stripper tower feed drum 34 (combined streams 40 and 42) has a relatively high content of $C_4$ and $C_5$ components. As this stream is further chilled, the $C_4$ and $C_5$ components act as an absorption liquid and lower the light ends partial pressure thereby permitting the condensation of $C_2$ and $C_3$ components at higher temperature levels. The stripper tower 24 makes this possible by making a controlled separation between the $C_4$ and $C_5$ components and the $C_6$ and heavier components to optimize the availability of the absorption components without the freezing potential of the $C_6$ and heavier components.

The combined steam 44 is progressively chilled against cold process streams and against mechanical refrigeration in the heat exchange units 46, 48 and 50 as will be further explained hereinafter. The temperature is dropped to the range of −110° C. to −72° C. and preferably to −98° C. and then fed to the separator or first demethanizer feed drum 52 where liquid stream 54 and vapor stream 56 are withdrawn. The liquid stream 54 from the first demethanizer feed drum 52 is split into multiple streams with a portion being passed in heat exchange relationship with the stream 44. In the preferred embodiment, stream 54 which contains some of the $C_2$ and most of the $C_3$ and heavier components is split into three parts with the first split stream 58 being fed at −110° C. to −72° C., preferably −98° C., into a midpoint elevation of the demethanizer column 60. The second and third split streams 62 and 64 are fed to the heat exchangers 48 and 46, respectively where these cold streams (−98° C.) progressively cool the stream 44 followed by further mechanical refrigeration at 50 down to −98° C. The split streams 62 and 64, which have now been slightly heated to different degrees, are fed to respective lower elevations in the demethanizer column 60 according to their temperatures, the highest temperature to the lowest column position.

This splitting of the stream 54 into multiple streams 58, 62 and 64 and heat exchange with the incoming stream 44, permits optimization of the temperature and enthalpy balance around the demethanizer tower 60.

Since the streams 44 and thus stream 54 contain a quantity of $C_4$ and $C_5$, the liquid 54 from the demethanizer feed drum 52 contains most of the $C_2$ and $C_3$ components absorbed into the $C_4$ and $C_5$ even though the temperature is only down to −98° C. and the pressure at this point is only about 10.59 bars. The overhead 56 from the drum 52 contains primarily all the hydrogen and almost all of the methane as shown in the table. This overhead 56 is further cooled at 66 down to a range of −145° C. to −120° C. and preferably to −134° C. This stream 56 is then separated in the second demethanizer feed drum 68 to provide liquid stream 70 and vapor stream 72. At this temperature of 134° C., the $C_2$ content of the vapor is less than 1% of the $C_2$ contained in the cracked gas feed. The liquid stream 70, which contains virtually all of the remaining $C_2$ and heavier components as well as methane and some hydrogen, is fed to the demethanizer column 60 near the top. The vapor stream 72 containing essentially only hydrogen and methane with a very small quantity of $C_2$ is combined with the overhead 74 from the demethanizer tower 60 and fed to the heat exchanger 76 and compressor 78. The exit stream 80 from the compressor 78 is at a pressure in the range of 25 to 45 bars and preferably at 38.25 bars and a gas temperature of 100° C. The gas stream 80 is brought into heat exchange contact at 76 with the combined streams 72 and 74 whereby the stream 80 is cooled to a range of −140° C. to −100° C. and preferably −116° C. and partially condensed. This stream is fed to the demethanizer reflux drum 82 where essentially all of any remaining $C_2$ is removed as liquid recycle to the demethanizer column 60 through the pressure reduction valve 84 which drops the temperature to about −138° C. The pressure reduction valve 84 also provides the lowest level of mechanical refrigeration to the top column feed. The vapor stream 86 from the reflux drum 82 now contains about equal molar fractions of methane and hydrogen with perhaps only about 0.01 mole % $C_2$ and is at a pressure of 37.66 bars. With this arrangement, a single compressor 78 produces a high pressure, high purity hydrogen stream while simultaneously providing the lowest level of refrigeration. Liquids condensed in the system are reduced in pressure (flashed) to provide the lowest level of refrigeration, while the uncondensed vapors form the feed to the hydrogen recovery section. The pressure of the flashed liquids is 3 bars to 10 bars, and preferably 6 bars.

The vapor stream 86 from the reflux drum 82 is fed to a hydrogen purification process or unit 88 where hydrogen 90 is separated from the methane 92 together with the minute quantity of $C_2$ that remains. This unit 88 may be a cryogenic device to produce hydrogen at pressures high enough to be used directly in other units, ranging from 25 to 45 bars, or a PSA device to produce hydrogen at lower pressures ranging from 3 to 15 bars.

We claim:

1. A method of processing, at a relatively low pressure, a cracked gas feedstream containing hydrogen, methane, $C_3$ to $C_5$ hydrocarbons and $C_6$ and heavier hydrocarbons to separate hydrogen and methane and produce a hydrogen stream at a relatively high pressure comprising:

a. compressing said feedstream to a pressure of less than 27 bars;

b. cooling said compressed feedstream to a temperature in the range of 10° to 25° C. thereby forming a first condensed portion and a first vapor portion of said compressed feedstream and separating said first condensed portion and said first vapor portion;

c. drying said first condensed portion and said first vapor portion;

d. cooling said dried first vapor portion to a temperature in the range of −20° to 5° C. thereby forming a second condensed portion and a second vapor portion;

e. feeding said first and second condensed portions to a stripper tower wherein said condensed portions are separated into a stripper bottoms containing essentially all of said $C_6$ and heavier hydrocarbons and a stripper overhead containing at least a portion of said $C_3$ to $C_5$ hydrocarbons;

f. combining said second vapor portion and said stripper overhead to produce a combined vapor stream containing hydrogen, methane and $C_3$ to $C_5$ hydrocarbons with essentially no $C_6$ and heavier hydrocarbons;

g. cooling said combined vapor stream to a temperature range of −110° to −72° C. thereby forming a third condensed portion and a third vapor portion;

h. dividing said third condensed portion into at least two demethanizer feed portions;

i. feeding a first one of said demethanizer feed portions directly to a demethanizer at a selected feed location;

j. heating a second one of said demethanizer feed portions to a temperature higher than said first one of said demethanizer feed portions and feeding into said demethanizer at a feed location below said selected feed location;

k. cooling said third vapor portion to a temperature range of −145° to −120° C. thereby forming a fourth condensed portion and a fourth vapor portion containing essentially only hydrogen, methane and a quantity of $C_2$ hydrocarbons;

l. feeding said fourth condensed portion to said demethanizer at a feed location above said selected feed location;

m. separating in said demethanizer an overhead containing essentially only hydrogen, methane and a quantity of $C_2$ hydrocarbons and a bottoms containing $C_2$ and heavier hydrocarbons;

n. compressing and thereby heating said demethanizer overhead and said fourth vapor portion to a pressure of 25 to 45 bars; and o. cooling said compressed demethanizer overhead and fourth vapor portion to a temperature in the range of −140° to −100° C. thereby forming a condensed demethanizer reflux and a vapor containing essentially only hydrogen and methane.

2. A method as recited in claim 1 wherein said step (j) of heating a second one of said demethanizer feed portions comprises the step of transferring heat from said combined vapor stream.

3. A method as recited in claim 1 wherein said third condensed portion is divided into three demethanizer feed portions and wherein said step (j) of heating a second one of said demethanizer feed portions further includes heating a third one of said demethanizer feed portions to a temperature higher than said second one of said demethanizer feed portions and feeding said third one of said demethanizer feed portions into said demethanizer at a feed location below said feed location of said second one of said demethanizer feed portions.

4. A method as recited in claim 3 wherein said step of heating said second and third ones of said demethanizer feed portions comprises the step of transferring heat from said combined vapor stream to said second and third ones of said demethanizer feed portions.

5. A method as recited in claim 1 wherein said step of cooling said compressed demethanizer overhead and fourth vapor portion comprises transferring heat to said demethanizer overhead and fourth vapor portion entering said compression.

6. A method of processing, at a relatively low pressure, a cracked gas feedstream containing hydrogen, methane, $C_3$ to $C_5$ hydrocarbons and $C_6$ and heavier hydrocarbons to separate hydrogen and methane and produce a hydrogen stream at a relatively high pressure comprising:

a. compressing said feedstream to a pressure of less than 27 bars;

b. cooling said compressed feedstream to a temperature in the range of 10° to 25° C. thereby forming a first condensed portion and a first vapor portion of said compressed feedstream and separating said first condensed portion and said first vapor portion;

c. drying said first condensed portion and said first vapor portion;

d. treating said dried first condensed portion and said dried first vapor portion to separate therefrom essentially all of said $C_6$ and heavier hydrocarbons and form a vapor stream containing said hydrogen, methane and $C_5$ and lighter hydrocarbons with essentially no $C_6$ and heavier hydrocarbons;

e. cooling said vapor stream thereby forming at least one condensed demethanizer feed portion and a further vapor portion;

f. feeding said condensed demethanizer feed portion to at least one selected feed location of a demethanizer;

g. separating in said demethanizer an overhead containing essentially only hydrogen and methane and a quantity of $C_2$ hydrocarbons and a bottoms containing essentially $C_2$ and heavier hydrocarbons;

h. compressing said demethanizer overhead and said further vapor portion to a pressure of 25 to 45 bars; and i. cooling said compressed demethanizer overhead and further vapor portion to a temperature in the range of −140° C. to −100° C. thereby forming a condensed demethanizer reflux and a vapor containing essentially only hydrogen and methane.

7. A method as recited in claim 6 wherein step (e) of forming at least one condensed demethanizer feed portion comprises forming at least two of said portions and wherein at least one of said portions is heated by heat exchange with said vapor stream prior to cooling step (e).

8. A method as recited in claim 6 wherein said cooling step (e) comprises the steps of:

j. cooling said vapor stream to a temperature of −110° to −72° C. thereby forming a vapor stream and a condensed portion;

k. dividing said condensed portion into at least two demethanizer feed portions;

l. feeding a first one of said demethanizer feed portions to a demethanizer column at a selected feed location;

m. heating a second one of said demethanizer feed portions to a temperature higher than said first one of said demethanizer feed portions and feeding said second one of said demethanizer feed portions into said demethanizer column at a feed location below said selected feed location;

o. cooling said vapor portion to a temperature range of −145° to 120° C. thereby forming a further condensed portion and a further vapor portion containing essentially only hydrogen, methane and a quantity of $C_2$ hydrocarbons;

p. feeding said further condensed portion to said demethanizer column at a feed location above said selected feed location;

q. separating in said demethanizer column an overhead containing essentially only hydrogen, methane and a quantity of $C_2$ hydrocarbons and a bottoms containing $C_2$ and heavier hydrocarbons;

r. heating and compressing said demethanizer column overhead and said further vapor stream to form a compressed stream at a pressure in excess of 25 bars;

s. cooling said compressed stream by heat exchange with said demethanizer overhead and said further vapor stream to a temperature of −140° to −100° C. thereby forming a condensed demethanizer reflux and an overhead vapor product containing essentially only hydrogen and methane; and t. reducing the pressure of said demethanizer reflux and feeding to said demethanizer column at a top feed location.

* * * * *